US009638075B2

(12) United States Patent
Qiao et al.

(10) Patent No.: US 9,638,075 B2
(45) Date of Patent: May 2, 2017

(54) HIGH PERFORMANCE NICKEL-BASED ALLOY

(71) Applicant: L. E. Jones Company, Menominee, MI (US)

(72) Inventors: Cong Yue Qiao, Menominee, MI (US); Lawrence A. Bowsher, Marinette, WI (US); Daniel E. Ward, Marinette, WI (US); Scott A. Smith, Peshtigo, WI (US)

(73) Assignee: L.E. Jones Company, Menominee, MI (US)

( * ) Notice: Subject to any disclaimer, the term of this patent is extended or adjusted under 35 U.S.C. 154(b) by 507 days.

(21) Appl. No.: 14/093,700

(22) Filed: Dec. 2, 2013

(65) Prior Publication Data

US 2015/0152752 A1 Jun. 4, 2015

(51) Int. Cl.

| | |
|---|---|
| ***C22C 19/00*** | (2006.01) |
| ***C22C 19/03*** | (2006.01) |
| ***C22C 19/05*** | (2006.01) |
| ***F01L 3/02*** | (2006.01) |
| ***C22C 30/00*** | (2006.01) |
| ***C22C 38/44*** | (2006.01) |

(Continued)

(52) U.S. Cl.

CPC ..... *F01L 3/02* (2013.01); *C22C 19/05* (2013.01); *C22C 19/053* (2013.01); *C22C 19/055* (2013.01); *C22C 30/00* (2013.01); *C22C 38/02* (2013.01); *C22C 38/04* (2013.01); *C22C 38/44* (2013.01); *Y10T 29/49306* (2015.01)

(58) Field of Classification Search

CPC ..... C22C 19/00; C22C 19/03; C22C 19/05; C22C 19/053; C22C 19/055; C22C 30/00; F01L 3/02; Y10T 29/49306

USPC ..... 420/441

See application file for complete search history.

(56) References Cited

U.S. PATENT DOCUMENTS

| | | |
|---|---|---|
| 2,742,356 A | 4/1956 | Prasse et al. |
| 2,827,373 A | 3/1958 | Prasse et al. |

(Continued)

FOREIGN PATENT DOCUMENTS

| | | |
|---|---|---|
| JP | S55-100949 A | 8/1980 |
| JP | S58-120756 A | 7/1983 |

(Continued)

OTHER PUBLICATIONS

Kajihara, Masanori, Kikuchi, Makoto, & Tanaka, Ryohei. (1986). Calculation of the equilibrium phase diagram of the Ni—Cr—W ternary system. Tetsu to Hagane, 72(7), 862-869.*

(Continued)

*Primary Examiner* — Jessee Roe
*Assistant Examiner* — Anthony Liang
(74) *Attorney, Agent, or Firm* — Buchanan Ingersoll & Rooney PC

(57) ABSTRACT

A nickel-based alloy includes, in weight percent, carbon from about 0.7 to about 2%; manganese up to about 1.5%; silicon up to about 1.5%; chromium from about 25 to about 36%; molybdenum from about 5 to about 12%; tungsten from about 12 to about 20%; cobalt up to about 1.5%; iron from about 3.5 to about 10%; nickel from about 20 to about 55%; and incidental impurities. The alloy is suitable for use in elevated temperature applications such as in valve seta inserts for internal combustion engines.

8 Claims, 9 Drawing Sheets

Approx. 500X magnification

(51) Int. Cl.
*C22C 38/04* (2006.01)
*C22C 38/02* (2006.01)

(56) References Cited

U.S. PATENT DOCUMENTS

| | | | |
|---|---|---|---|
| 3,171,739 | A | 3/1965 | Cape |
| 3,183,082 | A | 5/1965 | Konecsni |
| 3,838,981 | A | 10/1974 | Foley et al. |
| 3,853,545 | A | 12/1974 | Kusaka et al. |
| 3,859,083 | A | 1/1975 | Kusaka et al. |
| 3,925,065 | A | 12/1975 | Osawa et al. |
| 4,075,999 | A | 2/1978 | Danis |
| 4,093,454 | A | 6/1978 | Saito et al. |
| 4,183,774 | A | 1/1980 | Balleret |
| 4,228,223 | A | 10/1980 | Knotek et al. |
| 4,331,741 | A | 5/1982 | Wilson |
| 4,430,297 | A | 2/1984 | Crook |
| 5,246,661 | A | 9/1993 | Culling |
| 5,314,659 | A | 5/1994 | Hidaka et al. |
| 5,360,592 | A | 11/1994 | Culling |
| 5,674,449 | A | 10/1997 | Liang et al. |
| 6,482,275 | B1 | 11/2002 | Qiao |
| 7,754,142 | B2 | 7/2010 | Liang |
| 8,613,886 | B2 | 12/2013 | Qiao et al. |
| 2007/0086910 | A1 | 4/2007 | Liang |
| 2010/0272597 | A1* | 10/2010 | Qiao ..... C22C 19/053 420/453 |

FOREIGN PATENT DOCUMENTS

| | | | |
|---|---|---|---|
| JP | S59-074266 | | 4/1984 |
| WO | 2008/005243 | A2 | 1/2008 |
| WO | WO 2010/123552 | A2 | 10/2010 |

OTHER PUBLICATIONS

International Search Report and Written Opinion mailed Mar. 26, 2015 for PCT/US2014/064775.

* cited by examiner

Approx. 500X magnification

Approx. 500X magnification

Approx. 500X magnification

Approx. 500X magnification

HIGH PERFORMANCE NICKEL-BASED ALLOY

FIELD

The present disclosure relates to nickel-based alloys. More specifically, the present disclosure pertains to nickel-based alloys having high hardness, compressive yield strength, wear resistance, ultimate tensile strength, thermal conductivity, castability, and/or machinability, which may be used for engine parts such as valve seat inserts.

BACKGROUND INFORMATION

Nickel-based valve seat insert alloys generally have wear resistance, heat resistance, and corrosion resistance superior to those of high alloy steels, and are often used as materials for structural members serving under severe conditions, such as valve seat inserts. Known nickel-based alloys have relatively good characteristics, including good hardness and compressive yield strengths. Known nickel-based alloys include the alloy identified as J96 (available from L. E. Jones Company of Menominee, Mich.), which has good hardness and compressive yield strength.

The alloy identified as J89 is also marked by L. E. Jones Company—the details of this alloy are provided in commonly assigned U.S. Pat. No. 6,482,275, the disclosure of which is hereby incorporated by reference in its entirety. In general, the J89 alloy includes, in weight percent, 2.25 to 2.6% C, up to 0.5% Mn, up to 0.6% Si, 34.5 to 36.5% Cr, 4.00 to 4.95% Mo, 14.5 to 15.5% W, 5.25 to 6.25% Fe, balance Ni plus incidental impurities.

The nickel-based alloy identified as J91 (available from L.E. Jones Company) is described in commonly assigned U.S. Patent Application Publication No. 2008/0001115 (U.S. patent application Ser. No. 11/476,550), the entire disclosure of which is hereby incorporated by reference in its entirety.

SUMMARY

In embodiments, the present disclosure provides a nickel-based alloy containing, in weight percent, carbon from about 0.7 to about 2%; manganese up to about 1.5%; silicon up to about 1.5%; chromium from about 25 to about 36%; molybdenum from about 5 to about 12%; tungsten from about 12 to about 20%; cobalt up to about 1.5%; iron from about 3.5 to about 10%; nickel from about 20 to about 55%; and incidental impurities.

In further embodiments, the nickel-based alloy may contain, in weight percent, carbon from about 1 to about 1.9%; manganese up to about 0.6%; silicon up to about 0.7%; chromium from about 26 to about 33%; molybdenum from about 6.5 to about 10%; tungsten from about 14.5 to about 16.5%; cobalt up to about 0.6%; iron from about 5 to about 8.5%; nickel from about 29 to about 44%; and incidental impurities.

In further embodiments, the nickel-based alloy may contain, in weight percent, carbon from about 1.1 to about 1.8%; manganese from about 0.1 to about 0.6%; silicon from about 0.1 to about 0.7%; chromium from about 28.5 to about 33%; molybdenum from about 7 to about 9%; tungsten from about 14.5 to about 16.5%; cobalt up to about 0.6%; iron from about 5 to about 8.5%; nickel from about 29 to about 44%; and incidental impurities.

In embodiments, the present disclosure provides a valve seat insert for an internal combustion engine, wherein the valve seat insert is made of a nickel-based alloy comprising, in weight percent, carbon from about 0.7 to about 2%; manganese up to about 1.5%; silicon up to about 1.5%; chromium from about 25 to about 36%; molybdenum from about 5 to about 12%; tungsten from about 12 to about 20%; cobalt up to about 1.5%; iron from about 3.5 to about 10%; nickel from about 20 to about 55%; and incidental impurities.

DETAILED DESCRIPTION

In embodiments, the present disclosure provides a nickel-based alloy useful for a valve seat insert, which will now be described in detail with reference to a few embodiments thereof as illustrated in the accompanying drawings. In the following description, numerous specific details are set forth in order to provide a thorough understanding of the nickel-based alloy. It will be apparent, however, to one of ordinary skill in the art that embodiments herein may be practiced without some or all of these specific details. In other instances, well known process steps and/or structures have not been described in detail, so as to not unnecessarily obscure the nickel-based alloy.

In this specification and the claims that follow, singular forms such as "a", "an", and "the" may also include plural forms unless the content clearly dictates otherwise.

Unless otherwise indicated, all numbers expressing quantities, conditions, and the like in the instant disclosure and claims are to be understood as modified in all instances by the term "about." The term "about" refers, for example, to numerical values covering a range of plus or minus 10% of the numerical value.

The terms "room temperature," "ambient temperature," and "ambient" refer, for example, to a temperature of from about 20° C. (about 68° F.) to about 25° C. (about 77° F.).

Figure 1:
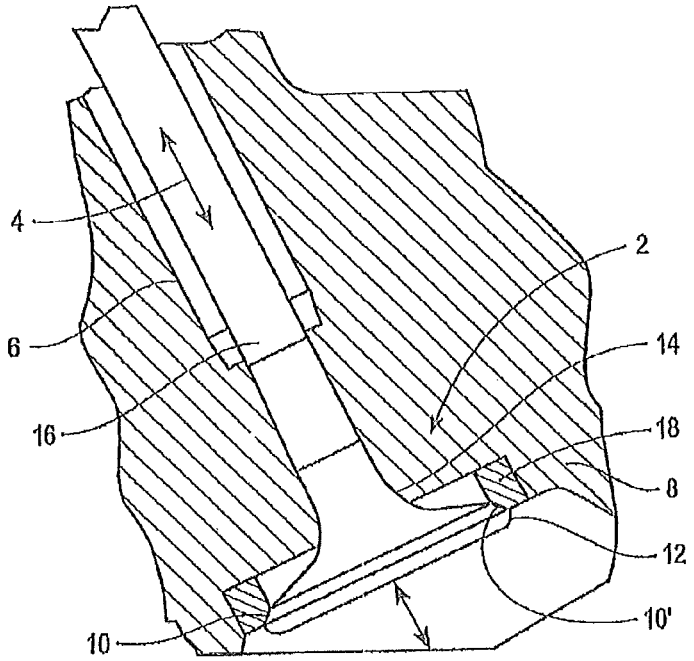
FIG. 1 is a cross-sectional view of a valve assembly incorporating a valve seat insert of a nickel-based alloy according to an embodiment of the disclosure (referred to herein as the J95 alloy).

FIG. 1 illustrates an engine valve assembly 2 according to the instant disclosure. Valve assembly 2 includes a valve 4, which may be slideably supported within the internal bore of a valve stem guide 6 and valve seat insert 18. The valve stem guide 6 is a tubular structure that fits into the cylinder head 8 of an engine. Arrows indicate the direction of motion of the valve 4. Valve 4 includes a valve seat face 10 interposed between the cap 12 and neck 14 of the valve 4. Valve stem 16 is positioned above neck 14 and is received within valve stem guide 6. The valve seat insert 18 includes a valve seat insert face 10' and is mounted, such as by press-fitting, within the cylinder head 8 of the engine. In embodiments, the cylinder head 8 may comprise a casting of cast iron, aluminum, or aluminum alloy. In embodiments, the insert 18 (shown in cross section) is annular in shape and the valve seat insert face 10' engages the valve seat face 10 during movement of valve 4.

In embodiments, the present disclosure relates to a nickel-based alloy (hereinafter referred to as the "J95 alloy" or "J95"). The castability, machinability, toughness, hardness, compressive yield strength, ultimate tensile rupture strength, wear resistance, and thermal conductivity of the J95 alloy make it useful in a variety of applications including, for example, as a valve seat insert for an internal combustion engine, and in ball bearings, coatings, and the like. In embodiments, the alloy is used as a valve seat insert for an internal combustion engine.

In embodiments, the J95 alloy comprises, in weight percent, carbon from about 0.7 to about 2%; manganese up to about 1.5%; silicon up to about 1.5%; chromium from about 25 to about 36%; molybdenum from about 5 to about 12%; tungsten from about 12 to about 20%; cobalt up to about 1.5%; iron from about 3.5 to about 10%; nickel from about 20 to about 55%; and incidental impurities.

In embodiments, the J95 alloy can have optional additions of other alloying elements, or can be free of intentional additions of such elements. In embodiments, the balance of the J95 alloy is nickel and incidental impurities. In embodiments, nickel may be present in the alloy in an amount of from about 20 to about 55 weight percent, such as from about 25 to about 50 weight percent, or from about 29 to about 44 weight percent. In embodiments, the J95 alloy may contain from 0 to about 1.5 weight percent of other elements (such as less than about 1 weight percent, or less than about 0.5 weight percent), such as, for example, aluminum, arsenic, bismuth, copper, calcium, magnesium, nitrogen, phosphorus, lead, sulfur, tin, titanium, yttrium and rare earth elements (lanthanides), zinc, tantalum, selenium, hafnium, and zirconium.

In embodiments, the J95 alloy consists essentially of, in weight percent, carbon from about 0.7 to about 2%; manganese up to about 1.5%; silicon up to about 1.5%; chromium from about 25 to about 36%; molybdenum from about 5 to about 12%; tungsten from about 12 to about 20%; cobalt up to about 1.5%; iron from about 3.5 to about 10%; nickel from about 20 to about 55%; and incidental impurities. As used herein, the terms "consists essentially of" or "consisting essentially of" have a partially closed meaning—that is to say, such terms exclude steps, features, or additional elements which would substantially and adversely change the basic and novel properties of the alloy (i.e., steps or features or additional elements which would have a detrimental effect on the desired properties of the J95 alloy). The basic and novel properties of the J95 alloy may include at least one of the following: castability, machinability, toughness, hardness, compressive yield strength, ultimate tensile rupture strength, wear resistance, thermal conductivity, and alloy microstructure.

In embodiments, the J95 alloy may be processed to achieve a combination of castability, machinability, toughness, hardness, compressive yield strength, ultimate tensile rupture strength, wear resistance, and thermal conductivity suitable for valve seat inserts. The J95 alloy may be processed according to any suitable technique. Techniques for processing the J95 alloy include, for example, powder metallurgy, casting, hot forging, thermal/plasma spraying, weld overlay, laser cladding, surface modification, such as PVD, CVD, and the like.

In embodiments, the J95 alloy may be formed into a powder material by various techniques including, for example, ball milling elemental powders or atomization to form pre-alloyed powder. In embodiments, the powder material can be compacted into a desired shape of a part and sintered. The sintering process may be used to achieve desired properties in the part.

Valve seat inserts may be manufactured by casting, which is a known process involving melting alloy constituents and pouring the molten mixture into a mold. In embodiments, the alloy castings may optionally undergo heat treatment before machining into a final shape.

In embodiments, the J95 alloy may be used in the manufacture of valve seat inserts including, for example, valve seat inserts for use in diesel engines, such as diesel engines with or without EGR, natural gas engines, and duel fuel engine valve train applications. The J95 alloy may also find utility in other applications. For example, the J95 alloy may be used in valve seat inserts made for gasoline, natural gas, bi-fuel, or alternatively fueled internal combustion engines. In embodiments, J95 alloy valve seat inserts may be manufactured by conventional techniques.

The J95 alloy may also find utility in other applications where high temperature properties are advantageous, such as wear resistant coatings, internal combustion engine components, and diesel engine components.

Without being bound to any particular theory, it is believed that the unique microstructure of the J95 alloy (which in embodiments contains almost entirely eutectic reaction phases) and microstructural distribution of the J95 alloy (in which the eutectic reaction phases are finely and uniformly distributed) yields properties in the J95 alloy such as castability, machinability, toughness, hardness, compressive yield strength, ultimate tensile rupture strength, wear resistance, and thermal conductivity which are desirable for valve seat insert applications. In embodiments, the microstructure of the J95 alloy is entirely or almost entirely composed of eutectic reaction phases—that is to say, in embodiments, the J95 alloy comprises eutectic reaction phases in an amount of at least 95 volume percent, such as at least 97 volume percent, or about 100 volume percent eutectic phases. In embodiments, the microstructure of the J95 alloy consists essentially of eutectic reaction phases. In embodiments, the eutectic reaction phases in the J95 alloy have lamellar morphology in as-cast form and are finely and uniformly distributed in the microstructure.

In embodiments, the length of the eutectic phases is less than about 1 micron. Without being bound to any particular theory, it is believed that the length of the eutectic phases is more sensitive to casting conditions than the width, and thus may vary depending on the casting conditions. For example, in embodiments, the length of the eutectic phases may be from about 1 to about 20 microns, such as less than about 15 microns, or less than about 10 microns.

Figure 2:
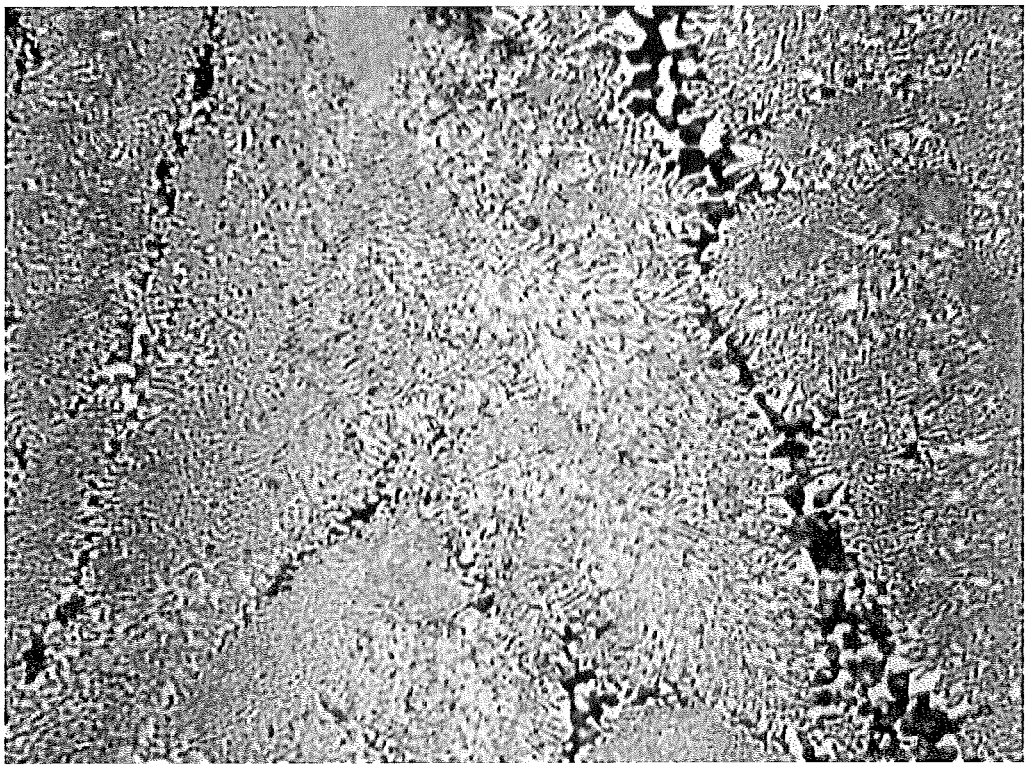
FIG. 2 is an optical light microscopy (OLM) micrograph depicting the microstructural morphology in the J95 alloy (experimental heat 8).

FIG. 2 is a micrograph of the microstructural morphology of one embodiment of the J95 alloy. As shown in FIG. 2, while there may be a very small amount of, for example, solid solution phases (potentially in the lighter-colored areas of the micrograph in FIG. 2), the microstructural morphology illustrated in FIG. 2 is almost entirely (i.e., about 100 volume %) eutectic reaction phases. These eutectic reaction phases have a lamellar morphology and are finely distributed.

In embodiments, the microstructure of the J95 alloy is free or nearly free of primary carbide phases—for example, in embodiments, the microstructure of the J95 alloy contains less than about 2 volume percent of primary carbide phases, such as less than about 1 volume percent, or less than about 0.5 volume percent, or less than about 0.1 volume percent, or is free of primary carbide phases (i.e., contains 0 volume percent primary carbide phases). In embodiments, the microstructure of the J95 alloy is nearly free or free of nickel solid solution phases—for example, in embodiments, the J95 alloy contains less than about 2 volume percent nickel solid solution phases, such as less than about 1 volume percent, or less than about 0.5 volume percent, or less than about 0.1 volume percent, or is free of nickel solid solution phases (i.e., contains 0 volume percent nickel solid solution phases). In a preferred embodiment, the microstructure of the J95 alloy is free of both primary carbide phases and nickel solid solution phases—that is to say, in embodiments, the J95 alloy contains no detectable primary carbide phases and no detectable nickel solid solution phases. Some nickel alloys used for valve seat insert applications use primary carbide phases or nickel solid solution phases to achieve desirable properties such as wear resistance, hardness, machinability, or a low linear expansion coefficient—in the J95 alloy, primary carbide phases and nickel solid solution phases are not required to achieve these desirable properties. That is to say, in embodiments, the J95 alloy is free or nearly free (i.e., less than 2 volume percent) of primary carbides and nickel solid solution phases while still achieving desirable properties for valve seat insert applications, such as castability, machinability, toughness, hardness, compressive yield strength, ultimate tensile rupture strength, wear resistance, and thermal conductivity.

In embodiments, the J95 alloy may have a high level of hardness. For example, in embodiments, the J95 alloy may have an as-cast bulk hardness of greater than about 45 HRc, such as greater than about 50 HRc, or greater than about 55 HRc, or from about 45 to about 60 HRc, or from about 50 to about 55 HRc.

In embodiments, the J95 alloy exhibits toughness satisfactory for use in valve seat insert applications. For example, in embodiments, a valve seat insert made of the J95 alloy may have a rupture toughness from about 0.3 to about 0.8 (×8.33 ft-lb), or greater than about 0.4 (×8.33 ft-lb), such as from about 0.4 to about 0.7 (×8.33 ft-lb).

In embodiments, the J95 alloy has a high ultimate tensile strength and compressive yield strength—that is to say, the J95 alloy has an ultimate tensile strength and compressive yield strength suitable for use in valve seat insert applications. In general, a greater ultimate tensile strength corresponds to a greater resistance to insert cracking, and a greater compressive yield strength corresponds to higher valve seat insert retention capability and valve/valve seat insert seating surfaces deformation recession (i.e., deformation wear). Further, a material with a higher compressive yield strength can beneficially be used in thinner wall concepts for valve seat inserts. In embodiments, the J95 alloy has a compressive yield strength of greater than about 100 ksi at temperatures from about room temperature (77° F.) to about 1000° F., such as greater than about 110 ksi, or greater than about 120 ksi, or greater than about 130 ksi. For example, in embodiments, the compressive yield strength of the alloy at room temperature is greater than about 130 ksi. In embodiments, the ultimate tensile rupture strength of the J95 alloy is greater than about 30 ksi, such as from about 40 to about 70 ksi at a temperature of from about 75° F. (room temperature) to about 600° F. For example, in embodiments, the ultimate tensile rupture strength of the J95 alloy is greater than about 60 ksi at 77° F.

In embodiments, the J95 alloy has a high thermal conductivity suitable for use in valve seat insert applications. Thermal conductivity of valve seat insert materials influences their performance—a valve seat insert material with high thermal conductivity can more effectively transfer heat away from the engine valves in order to prevent overheating. In embodiments, the J95 alloy has a thermal conductivity of from about 8 to about 22 W/mK, such as from about 10 to about 20 W/mK, at temperatures from about room temperature to about 700° C.

In embodiments, the J95 alloy may have a linear thermal expansion coefficient suitable for use in valve seat insert applications. For example, in embodiments, the J95 alloy has a linear thermal expansion coefficient of from about $11\times10^{-6}$ mm/mm° C. to about $17\times10^{-6}$ mm/mm° C.

In embodiments, the J95 alloy contains a suitable amount of carbon, which contributes to the hardness of the alloy. For example, in embodiments, the J95 alloy contains from about 0.7 to about 2 weight percent carbon, such as from about 1 to about 1.9 weight percent carbon, or from about 1.1 to about 1.8 weight percent carbon, or from about 1.3 to about 1.7 weight percent carbon.

In embodiments, a suitable amount of chromium improves corrosion resistance in the J95 alloy. In embodiments, the J95 alloy contains from about 25 to about 36 weight percent chromium, such as from about 26 to about 33 weight percent, or from about 28.5 to about 33 weight percent chromium.

In embodiments, tungsten is present in the J95 alloy in an amount ranging from about 12 to about 20 weight percent, such as from about 13 to about 18 weight percent, or from about 14.5 to about 16.5 weight percent.

In embodiments, iron is present in the J95 alloy in an amount ranging from 3.5 to about 10 weight percent, such as from about 4 to about 9 weight percent, or from about 5 to about 8.5 weight percent.

In embodiments, the J95 alloy contains molybdenum in an amount of from about 5 to about 12 weight percent, such as from about 6 to about 11 weight percent, or from about 6.5 to about 10 weight percent, or from about 7 to about 9 weight percent.

In embodiments, manganese may be added or present in the J95 alloy in an amount of up to about 1.5 weight percent, such as up to about 0.6 weight percent, or up to about 0.5 weight percent, or up to about 0.4 weight percent, or up to about 0.2 weight percent. For example, in embodiments, manganese may be present in the J95 alloy in an amount of from 0 to about 1.5 weight percent, such as from about 0.1 to about 0.6 weight percent.

In embodiments, silicon may be added to or present in the J95 alloy in an amount of, for example, up to about 1.5 weight percent, such as up to about 0.7 weight percent, or up to about 0.5 weight percent, or up to about 0.3 weight percent. For example, in embodiments, the J95 alloy may contain from zero to about 1.5 weight percent silicon, such as from about 0.1 to about 0.7 weight percent silicon.

In embodiments, the J95 alloy may contain cobalt. For example, in embodiments, cobalt may be added to or present in the J95 alloy in an amount up to about 1.5 weight percent, such as up to about 0.7 weight percent, or up to about 0.06 weight percent, or up to about 0.5 weight percent, or up to about 0.3 weight percent. For instance, in embodiments, the J95 alloy may contain cobalt in an amount of from zero to about 1.5 weight percent, such as from about 0.05 to about 0.8 weight percent, or from about 0.1 to about 0.6 weight percent.

EXAMPLES

The following examples are illustrative of different compositions and conditions which may be used in practicing the embodiments of the present disclosure. All parts and proportions are by weight unless otherwise indicated. It will be apparent, however, that the embodiments may be practiced with many types of compositions and can have many uses in accordance with the disclosure above and as pointed out hereinafter.

The effects of compositional changes were explored by varying the composition of various experimental alloys. The compositions of Experimental Heats 1-11 are set forth in Table 1. For comparative purposes, J89 and J91 alloy compositions are also provided. Properties of the J95 alloy are discussed below. The term "remainder" refers to the weight percent sum of the very small amounts of additional elements present in the alloy that constitute the remaining weight percent of the alloy (i.e. wt. % of remainder=100%−($\Sigma a_i$ wt. %); where $\Sigma a_i$ is the summation of weight percent of all listed elements and $a_i$ is wt. % for an individual element from the element list).

TABLE 1

COMPOSITION OF EXPERIMENTAL HEATS

| Experimental Heat No. | | ELEMENTAL CONTENT C | Mn | Si | Cr | Mo | W | Fe | Ni | Impurities/ Remainder | As-Cast Bulk Hardness |
|---|---|---|---|---|---|---|---|---|---|---|---|
| 1 | 2K02XA | 1.6 | 0.17 | 0.47 | 28.83 | 8.62 | 14.98 | 5.47 | 39.53 | Impurities | 53.0 |
| 2 | 2K20XB | 1.35 | 0.22 | 0.58 | 28.50 | 8.47 | 14.91 | 5.30 | 39.91 | Co: 0.46 and Impurities | 53.6 |
| 3 | 2K20XC | 1.73 | 0.14 | 0.56 | 28.56 | 8.46 | 14.62 | 5.73 | 39.88 | Impurities | 54.0 |
| 4 | 2K21XA | 1.64 | 0.13 | 0.55 | 29.04 | 7.23 | 15.07 | 6.10 | 39.91 | Impurities | 54.3 |
| 5 | 2K21XB | 1.66 | 0.13 | 0.56 | 28.41 | 9.68 | 14.94 | 5.54 | 38.72 | Impurities | 56.0 |
| 6 | 2K30XA | 1.38 | 0.15 | 0.53 | 29.40 | 6.89 | 14.91 | 5.64 | 40.77 | Impurities | 52.3 |
| 7 | 2K30XB | 1.83 | 0.12 | 0.50 | 28.67 | 9.50 | 14.60 | 5.68 | 38.76 | Impurities | 55.6 |
| 8 | 2K28V | 1.45 | 0.19 | 0.34 | 31.35 | 7.96 | 15.45 | 6.42 | 36.57 | Impurities | 54.5 |
| | J89 | 2.40 | 0.25 | 0.45 | 34.50 | 4.50 | 15.00 | 5.75 | 37.50 | Impurities | 55.0 |
| | J91 | 1.00 | 0.20 | 0.50 | 30.50 | 4.75 | 15.00 | 5.75 | 42.00 | Impurities | 47.0 |

As shown in the above table, alloying elements distinguishing the J95 alloy heats (i.e., Experimental Heats 1-8) from the J89 and J91 alloys are carbon, molybdenum, and chromium.

Example 1: Insert Toughness Evaluation

Samples of the J95 alloy (experimental heats 2-7) were cast into valve seat inserts having identical sample geometry. The as-cast valve seat inserts were subjected to radial crush testing in ambient conditions to evaluate toughness. Crush testing was evaluated according to a modified version of the Metal Powder Industry Federation Standard 55 (determination of radial crush strength of powder metallurgy test specimens). A compressive load was applied to each valve seat insert in the radial orientation. As the sample was pressed, the sample under the force was deformed. Each sample was continuously pressed and the amount of deformation increased until the sample ruptured. The force applied on the sample at rupture was a function of material, sample geometry, temperature, and strain rate. The peak force and deformation at rupture obtained from radial crush testing is summarized in Table 2.

TABLE 2

INSERT RADIAL CRUSH TEST RESULTS

| | Heat Number | As-Cast Bulk Hardness | Force (lb) | Total Deformation Before Rupture (inch) | L.E. Jones Insert Toughness Index (8.33 ft-lb) |
|---|---|---|---|---|---|
| 2 | 2K20XB | 53.6 | 1826 | 0.026 | 0.473 |
| 3 | 2K20XC | 54.0 | 1762 | 0.027 | 0.480 |
| 4 | 2K21XA | 54.3 | 1741 | 0.025 | 0.438 |
| 5 | 2K21XB | 56.0 | 1773 | 0.027 | 0.479 |
| 6 | 2K30XA | 52.3 | 1763 | 0.027 | 0.478 |
| 7 | 2K30XB | 55.6 | 2097 | 0.030 | 0.625 |

The L.E. Jones Insert Toughness Index is calculated using the following formula:

L.E. Jones Insert Toughness Index=(force×total deformation at the break)/100 The unit of force is the pound, and the unit of total deformation is the inch—thus, the index unit is 8.33 ft-lb.

Insert rupture toughness can affect the desired insert performance, as well as insert machining process. For example, for some alloys, grinding response can be a significant challenge if an aggressive design is applied (i.e., thin wall featured geometry). As shown in Table 2, the insert rupture toughness for each sample was within a range of 0.438 to 0.625 (×8.33 ft-lb). Thus, the valve seat inserts tested exhibited satisfactory insert rupture toughness for valve seat insert applications.

Linear regression analysis was performed to analyze the bulk hardness (HRc) for the J95 alloy as a function of the five major alloying elements (i.e., carbon, chromium, molybdenum, tungsten, and iron). The regression result for the as-cast bulk hardness may be defined by Equation (1):

$$H_{as\text{-}cast}=-27.5+0.637C+0.681Cr+1.57Mo+2.24W+2.58Fe \quad (1)$$

Figure 3:
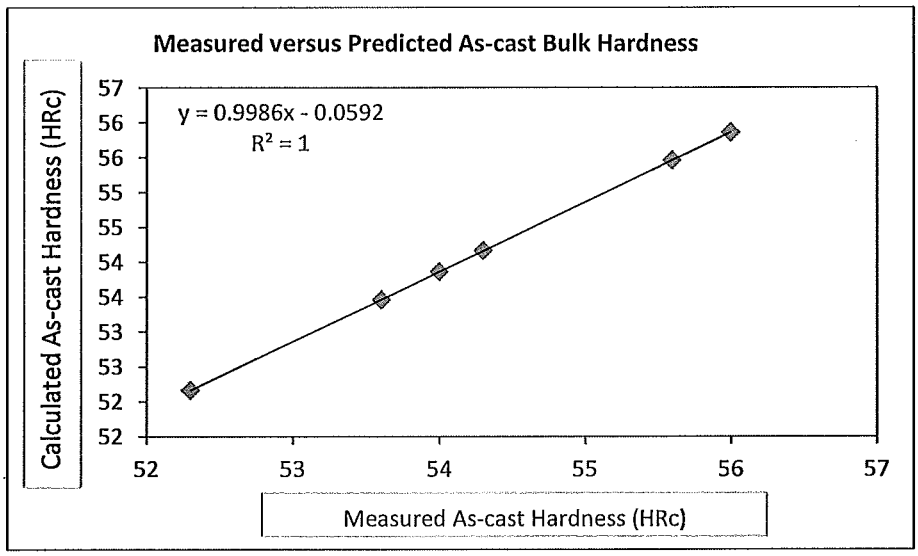
FIG. 3 is a graphical representation of the correlation between a measured and a calculated hardness for the J95 alloy.

When studying the relative effects of the various elements on bulk HRc, the relative effect of each element is the product of the coefficient and the elemental content (in weight percent). As shown in Equation 1, all five of the major alloying elements showed a positive effect on the bulk hardness. Thus, an increase in carbon, chromium, molybdenum, tungsten, and iron in the alloying elemental range studied will increase the alloy as-cast bulk hardness. FIG. 3 illustrates the correlation between the measured bulk hardness and the bulk hardness calculated using Equation (1). Within the alloying elemental range evaluated, a very good correlation was observed, with $R^2=1$ regression parameter. Within the alloy system evaluated, a sound linear correlation between predicted as-cast hardness and measured as-cast hardness was obtained. Furthermore, no bulk hardness change for the J95 alloy is expected when experiencing a thermal exposure under 1800° F.

Linear regression analysis was also performed to analyze the insert as-cast rupture toughness of the J95 alloy as a function of the five major alloying elements. The regression result for the as-cast rupture toughness may be defined by Equation (2) (where weight percent is applied for all of the alloying elements):

$$I_{as\text{-}cast}=-7.21+0.268C+0.296Cr+0.0789Mo-0.120W-0.0234Fe \quad (2)$$

As shown in Equation (2), carbon, chromium, and molybdenum had a positive effect on insert rupture toughness, while tungsten and iron had a negative effect on insert toughness. Thus, within the J95 alloy system range evaluated, an increase in carbon, chromium or molybdenum, or a decrease in tungsten or iron, will promote insert rupture toughness.

Figure 4:
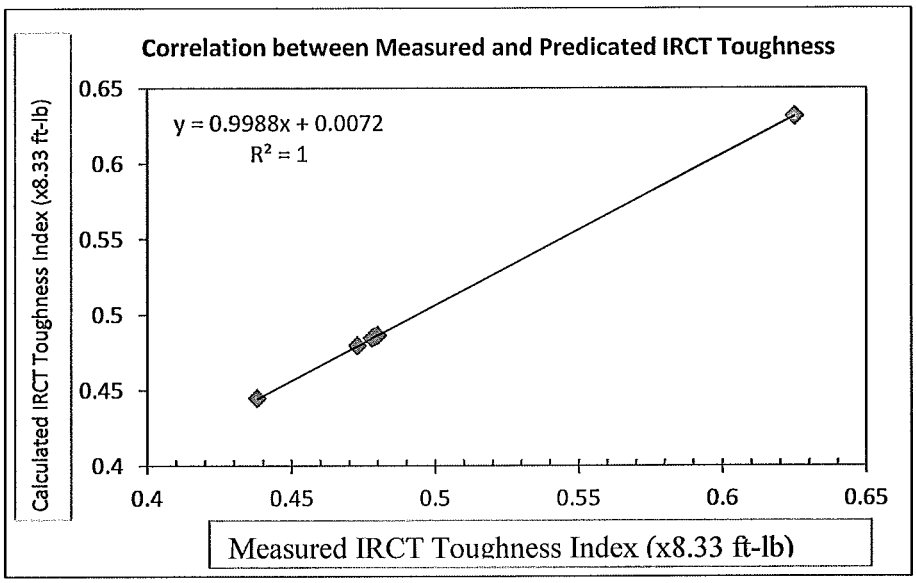
FIG. 4 is a graphical representation of the correlation between a measured and a calculated insert rupture toughness for the J95 alloy.

FIG. 4 illustrates the relationship between the measured insert rupture toughness and the insert rupture toughness calculated with Equation (2). Within the alloying elemental range evaluated, a very good correlation was observed with $R^2=1$ regression parameter. The results also implied that within the alloy system evaluated, a sound linear correlation between predicted radial crush toughness and measured radial crush toughness was obtained.

Example 2: Compressive Yield Strength and Tensile Rupture Strength

Samples of the J95 alloy (Experimental Heat 8), the J89 alloy, and the J91 alloy were evaluated to determine compressive yield strength following ASTM E209-89A (2000) (Standard Practice for Compression Tests of Metallic Materials at Elevated Temperatures with Conventional or Rapid Heating Rates and Strain Rates).

The composition of the J89 and J91 alloys tested is set forth in Table 3.

TABLE 3

J89 and J91 Alloy Composition

| Experimental Heat No. | | ELEMENTAL CONTENT C | Mn | Si | Cr | Mo | W | Fe | Ni | Impurities/ Remainder |
|---|---|---|---|---|---|---|---|---|---|---|
| J89 | 4E18D | 2.40 | 0.26 | 0.39 | 34.92 | 4.38 | 14.9 | 5.93 | 36.64 | Impurities |
| J91 | 3G30XA | 0.991 | 0.23 | 0.451 | 30.42 | 4.82 | 14.84 | 5.80 | 41.34 | Impurities |

Figure 5:
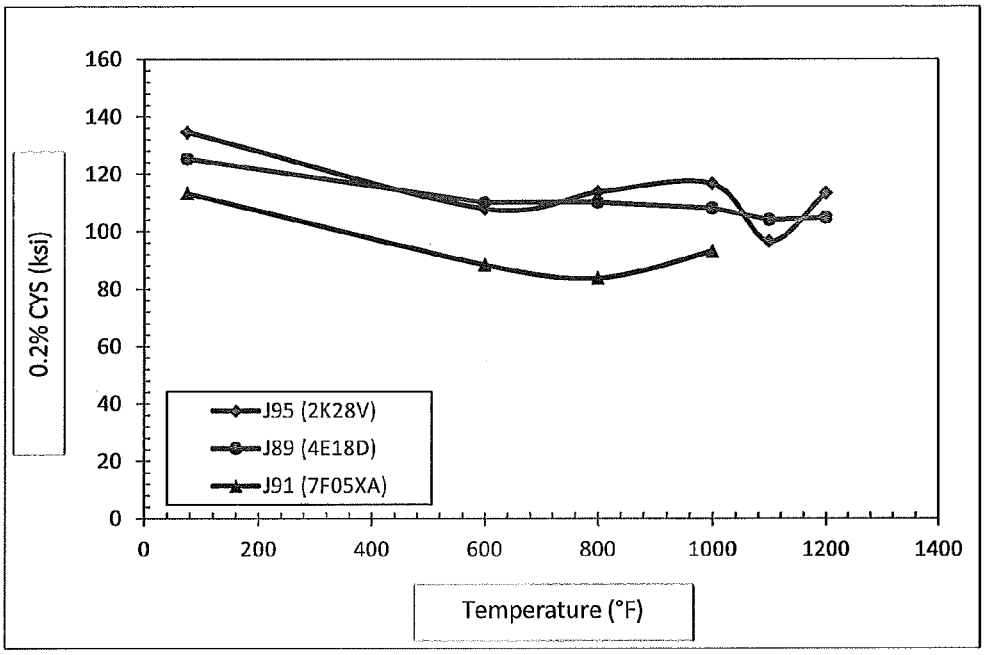
FIG. 5 is a graphical representation of the compressive yield strengths as a function of temperature for the J95 alloy (experimental heat 8) and the J89 and J91 alloys.

The results of the compression test results are set forth in Table 4. A graphical comparison of the compressive yield strength as a function of temperature for the J95 alloy, J89 alloy, and J91 alloy is set forth in FIG. 5.

TABLE 4

COMPRESSIVE YIELD STRENGTH OF J89, J91, AND J95

| Temp. | CYS (ksi) J89 | J91 | J95 | Young's Modulus msi J89 | J91 | J95 | Poisson's Ratio J89 | J91 | J95 |
|---|---|---|---|---|---|---|---|---|---|
| ° F. | 4E18D | 3G30X | 2K28V | 4E18D | 3G30X | 2K28V | | | |
| 77 | 125.3 | 91.1 | 134.5 | 30.1 | 26.6 | 40.4 | 0.235 | 0.299 | 0.212 |
| 600 | 110.1 | 79.1 | 107.9 | 30.7 | 28.4 | 25.0 | — | — | — |
| 800 | 110.2 | 118.8 | 113.7 | 30.8 | 26.3 | 29.4 | — | — | — |
| 1000 | 108.1 | 77.6 | 116.6 | 29.2 | 27.6 | 29.2 | — | — | — |
| 1100 | 104.1 | 78.3 | 96.5 | 29.6 | 28.8 | 29.3 | — | — | — |
| 1200 | 104.8 | 76.1 | 113.3 | 30.0 | 28.9 | 29.8 | — | — | — |

Compressive yield strength is one of the critical materials properties for valve seat insert applications in terms of valve seat insert retention capability and valve/valve seat insert deformation wear. In general, higher compressive yield strength is preferred for valve seat insert applications. A material with higher compressive yield strength can be beneficial to thinner wall concept of valve seat insert that has been a recent trend in engine design. As shown in Table 4, the compressive yield strength of the J95 alloy was approximately the same as that of the J89 alloy within the temperature range applied. Alloy J95 showed overall higher compressive yield strength (except at 1000° C.) than alloys J89 and J91 in the test temperature range applied.

The J95 alloy does not contain primary carbides, but it still possesses the same compressive yield strength as the J89 alloy, which is composed of eutectic matrix phases plus primary carbides. Without being bound to any particular theory, it is believed that the J95 alloy has such a high compressive yield strength because it is composed of fine eutectic reaction phases, while the J89 matrix is composed of significantly larger eutectic reaction phases. Thus, the design of the primary carbide free microstructure in the J95 alloy provides better overall wear resistance and assists in improving machinability and castability.

The J95 alloy was also evaluated for tensile strength for temperatures up to 1200° F. using ASTM E8-04 (2004) (Standard Test Methods for Tension Testing of Metallic Materials) and ASTM E21-05 (Standard Test for Ultimate Tensile Rupture Strength). The results of this testing are summarized in Table 5, and illustrated in FIG. 6.

TABLE 5

ULTIMATE TENSILE RUPTURE STRENGTH OF J89, J91, AND J95

| Temperature | UTS (ksi) | | | Young's Modulus msi | | | Poisson's Ratio | | |
|---|---|---|---|---|---|---|---|---|---|
| ° F. | J89 | J91 | J95 | J89 | J91 | J95 | J89 | J91 | J95 |
| 77 | 58.1 | 85.9 | 64.1 | 34.4 | 35.0 | 33.0 | 0.247 | 0.313 | 0.212 |
| 600 | 55.3 | 74.4 | 55.6 | 34.6 | 29.0 | 31.1 | — | — | — |
| 800 | 59.9 | 83.5 | 41.0 | 31.6 | 23.5 | 27.7 | — | — | — |
| 1000 | 59.5 | 59.8 | 46.4 | 31.9 | 22.8 | 27.7 | — | — | — |
| 1100 | 62.1 | 81.6 | 56.8 | 29.8 | 23.0 | 28.3 | — | — | — |
| 1200 | 66.0 | 74.4 | 57.3 | 27.0 | 26.5 | 28.5 | — | — | — |

Figure 6:
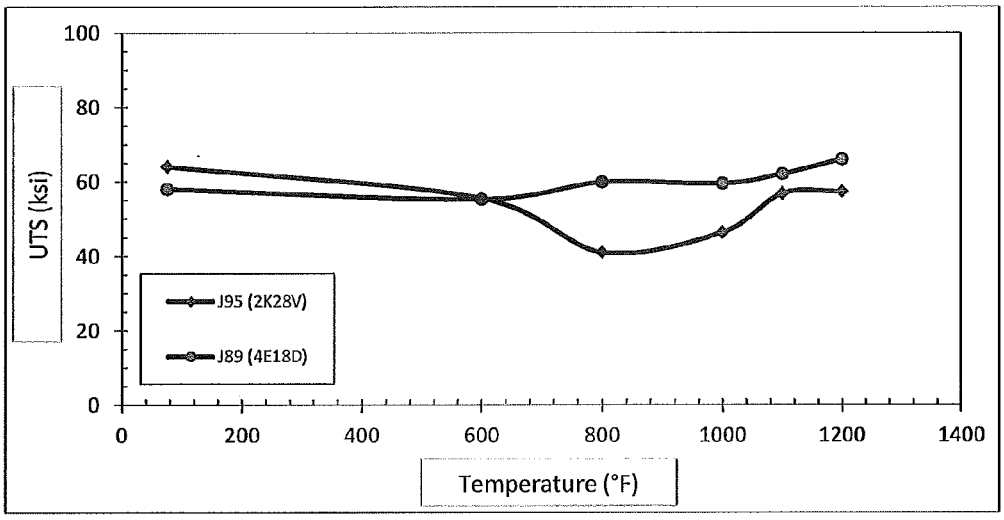
FIG. 6 is a graphical representation of the ultimate tensile rupture strength as a function of temperature for the J95 alloy, as compared to the J89 alloy.

As shown in Table 5 and FIG. 6, the J95 alloy exhibited similar tensile rupture strength as the J89 alloy. Thus, the J95 alloy should have sufficient tensile strength for valve seat insert applications.

Example 3: SEM Examination

Figure 7:
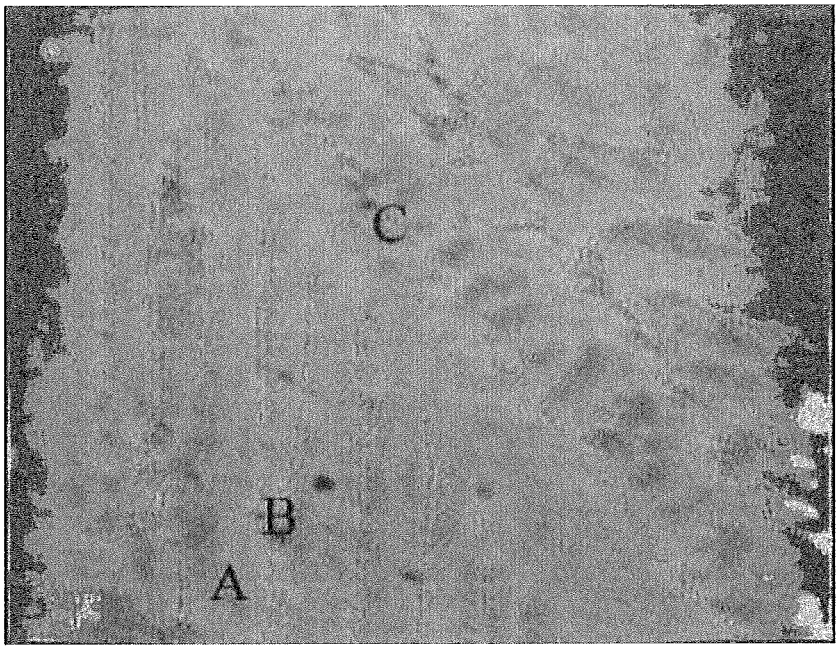
FIG. 7 is a scanning electron microscopy (SEM) micrograph depicting a backscattered electron image of the J95 microstructure in the as-cast condition.

FIG. 7 is a scanning electron microscopy (SEM) micrograph illustrating a backscattered electron image of the J95 alloy (experimental heat 8) in the as-cast condition. As shown in FIG. 7, with the z-contrast photomicrograph, fine eutectic microstructural morphology was revealed for the J95 alloy. The elemental segregation pattern was significantly weaker than typical high alloy castings.

Energy dispersive x-ray spectroscopy (EDS) analysis was carried out at three locations (intragranular location A, intercellular location B, and intergranular location C) to semi-quantitatively define the composition of each region. This semi-quantitative EDS analysis results showed that the primary compositional differences between Location A and Location B or Location C were carbon and molybdenum contents. That is to say, the carbon content in Location A was twice that for either Location B or Location C, while the molybdenum content in Locations B and C was twice that of Location A. The results indicated that there was no primary carbide formation. In addition, the eutectic structure (primarily lamella form) was finely distributed.

Figure 8:
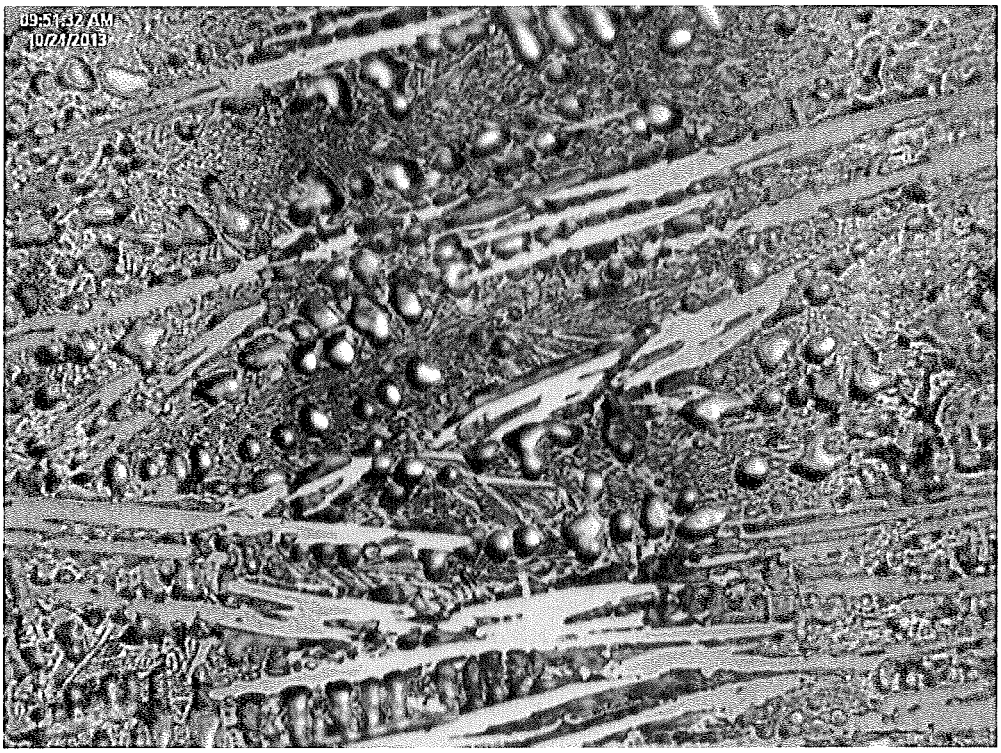
FIG. 8 is an OLM micrograph depicting the typical microstructural morphology of the J89 alloy, another nickel-based alloy.
Figure 9:
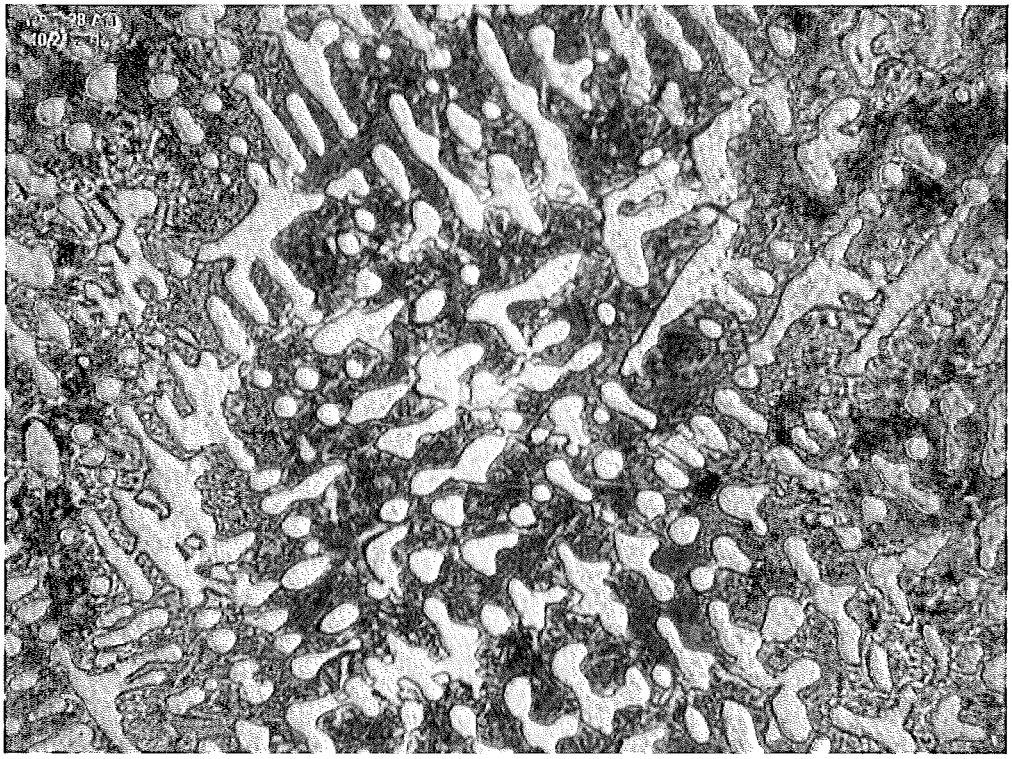
FIG. 9 is an OLM micrograph depicting the typical microstructural morphology of the J91 alloy, another nickel-based alloy.

In comparison, FIG. 8 and FIG. 9 illustrate the typical microstructural morphology of the J89 and J91 alloys, respectively. The composition of the J89 and J91 alloy samples is set forth in Table 6:

TABLE 6

Elemental Content of J89 and J91 Alloys

| Experimental Heat No. | ELEMENTAL CONTENT C | Mn | Si | Cr | Mo | W | Fe | Ni | Impurities/ Remainder |
|---|---|---|---|---|---|---|---|---|---|
| FIG. 8: J89 | 2.38 | 0.205 | 0.348 | 35.17 | 4.36 | 14.59 | 5.65 | 36.67 | Impurities |
| FIG. 9: J91 | 1.01 | 0.181 | 0.51 | 30.47 | 4.78 | 15.15 | 5.49 | 42.06 | Impurities |

The J89 alloy is a nickel-chromium-tungsten alloy containing a eutectic matrix strengthened by primary carbides exhibiting rod or H-shaped morphology. The J91 alloy is a Ni—Cr—W—Mo alloy that contains solid solution strengthened Ni phase and eutectic solidification structures (i.e., about 50 vol. % eutectic phases and 50 vol. % nickel solid-solution phase, with no primary carbides).

Example 4: Thermal Conductivity

The thermal conductivity of valve seat insert materials can affect their performance. A valve seat insert material with high thermal conductivity is desirable because it can effectively transfer heat away from engine valves to prevent overheating. The thermal conductivity of the J95 alloy was measured following ASTM E1461-01 (standard test method for thermal diffusivity of solids by the flash method).

The measurement was performed in a NETZSCH LFA 457 MicroFlash™ system on disc-shaped samples with a diameter of 0.5", a thickness of 0.079", and with a surface roughness of 50 microinches or less. A sample aligned between a neodymium glass laser (1.06 mm wavelength, 330 ms pulse width) and an indium antimonide (InSb) infrared detector in a high temperature furnace. During the measurement, the sample was stabilized at a test temperature before being heated using laser pulses on one surface of the sample. Temperature rise from the opposite surface was measured by the infrared device.

For comparative purposes, samples of the J89 and J91 alloys were also evaluated. The composition of the evaluated alloys is set forth in Table 7:

TABLE 7

| Experimental Alloy Compositions | | | | | | | | | | |
|---|---|---|---|---|---|---|---|---|---|---|
| Experimental | | ELEMENTAL CONTENT | | | | | | | | |
| | Heat No. | C | Mn | Si | Cr | Mo | W | Fe | Ni | Impurities/ Remainder |
| | J89 | 2.51 | 0.48 | 0.56 | 36.47 | 4.15 | 15.44 | 6.7 | 33.69 | Impurities |
| J91 | 1H28XA | 0.71 | 0.27 | 0.98 | 26.34 | 5.13 | 15.02 | 32.6 | 18.81 | Impurities |

A comparison between the thermal conductivity of the J95 alloy (experimental heat 8) and that of the J89 and J91 alloys is provided in Table 8.

TABLE 8

| THERMAL CONDUCTIVITY MEASUREMENT RESULTS Thermal Conductivity | | | | | | | | | | |
|---|---|---|---|---|---|---|---|---|---|---|
| | | Specific Heat | | | Conductivity | | | | | |
| Temperature | | J/g° K | | | W/mK | | | Btu/hr-ft-° F. | | |
| ° C. | ° F. | J89 | J91 | J95 | J89 | J91 | J95 | J89 | J91 | J95 |
| 25 | 77 | 0.434 | 0.395 | 0.345 | 9.3 | 9.5 | 8.3 | 5.4 | 5.5 | 4.8 |
| 100 | 212 | 0.453 | 0.403 | 0.363 | 10.3 | 11.0 | 9.2 | 6.0 | 6.4 | 5.3 |
| 200 | 392 | 0.481 | 0.421 | 0.383 | 12.0 | 12.7 | 10.7 | 6.9 | 7.4 | 6.2 |
| 300 | 572 | 0.502 | 0.446 | 0.398 | 13.8 | 15.0 | 12.2 | 8.0 | 8.7 | 7.1 |
| 400 | 752 | 0.522 | 0.460 | 0.419 | 15.5 | 16.7 | 14.0 | 9.0 | 9.7 | 8.1 |
| 500 | 932 | 0.534 | 0.470 | 0.441 | 17.1 | 18.4 | 16.1 | 9.9 | 10.6 | 9.3 |
| 600 | 1112 | 0.558 | 0.483 | 0.451 | 19.2 | 20.1 | 17.8 | 11.1 | 11.6 | 10.3 |
| 700 | 1292 | 0.577 | 0.487 | 0.497 | 21.3 | 21.4 | 20.9 | 12.3 | 12.4 | 12.1 |

As shown in Table 8, the J95 alloy had a slightly lower thermal conductivity as compared to the J89 and J91 alloys.

Without being bound to any particular theory, it is believed that the difference between J95 and J89 or J91 in thermal conductivity was most likely related to differences in their composition and microstructure.

Example 5: Thermal Expansion and Contraction Behavior

A sample of the J95 alloy (experimental heat 8) was used for studying the thermal expansion and contraction behavior of the J95 alloy. For comparative purposes, the thermal expansion coefficient of samples of the J89 alloy (Heat No. 4E18D) and the J91 alloy (Heat 7G10XA) were also measured. The composition of the evaluated alloys is set forth in Table 9.

TABLE 9

| J89 AND J91 ALLOY COMPOSITION | | | | | | | | | | |
|---|---|---|---|---|---|---|---|---|---|---|
| Experimental | | ELEMENTAL CONTENT | | | | | | | | |
| | Heat No. | C | Mn | Si | Cr | Mo | W | Fe | Ni | Impurities/ Remainder |
| J89 | 4E18D | 2.40 | 0.26 | 0.39 | 34.92 | 4.38 | 14.9 | 5.93 | 36.64 | Impurities |
| J91 | 7G10XA | 1.21 | 0.02 | 0.16 | 30.54 | 4.88 | 14.2 | 4.47 | 41.32 | Impurities |

The results of the linear thermal expansion coefficient measurement are set forth in table 10:

TABLE 10

| THERMAL EXPANSION BEHAVIOR OF ALLOYS J89, J91, AND J95 Linear Thermal Expansion Coefficient | | | | | | | |
|---|---|---|---|---|---|---|---|
| | | CTE | | | | | |
| Temperature | | $\times 10^{-6}$ mm/mm° C. | | | $\times 10^{-6}$ mm/mm° F. | | |
| ° C. | ° F. | J89 | J91 | J95 | J89 | J91 | J95 |
| 25~200 | 77~392 | 10.32 | 10.95 | 12.29 | 5.73 | 6.08 | 6.83 |
| 25~300 | 77~572 | 11.07 | 11.63 | 12.75 | 6.15 | 6.46 | 7.08 |
| 25~400 | 77~752 | 11.55 | 12.15 | 13.11 | 6.42 | 6.75 | 7.28 |
| 25~500 | 77~932 | 11.95 | 12.52 | 13.46 | 6.64 | 6.96 | 7.48 |

TABLE 10-continued

THERMAL EXPANSION BEHAVIOR OF ALLOYS J89, J91, AND J95
Linear Thermal Expansion Coefficient

| Temperature | | CTE | | | | | |
|---|---|---|---|---|---|---|---|
| | | $\times 10^{-6}$ mm/mm° C. | | | $\times 10^{-6}$ mm/mm° F. | | |
| ° C. | ° F. | J89 | J91 | J95 | J89 | J91 | J95 |
| 25~600 | 77~1112 | 12.38 | 13.01 | 14.06 | 6.88 | 7.23 | 7.81 |
| 25~700 | 77~1292 | 12.67 | 13.51 | 14.54 | 7.04 | 7.51 | 8.08 |
| 25~800 | 77~1472 | 12.90 | 13.86 | 14.94 | 7.17 | 7.70 | 8.30 |
| 25~900 | 77~1652 | 13.16 | 14.25 | 15.34 | 7.31 | 7.92 | 8.52 |
| 25~1000 | 77~1832 | 13.54 | 14.66 | 15.71 | 7.52 | 8.14 | 8.73 |

As shown in Table 10, the J95 alloy possessed a different linear thermal expansion coefficient as compared to the J89 and J91 alloys. Without being bound to any particular theory, it is believed that the difference in thermal expansion behavior is related to the differences in the microstructures of the alloys. The J95 alloy is suitable for use in valve seat insert applications.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A nickel-based alloy comprising, in weight percent:
carbon from about 0.7 to about 2%;
manganese up to about 1.5%;
silicon up to about 1.5%;
chromium from about 25 to about 36%;
molybdenum from at least 6.5 to about 12%;
tungsten from about 12 to about 20%;
cobalt up to about 1.5%;
iron from about 3.5 to about 10%;
nickel from about 20 to about 55%; and
incidental impurities, the alloy having an as-cast bulk hardness of over 52 HRc and a microstructure comprising eutectic reaction phases having a lamellar morphology and at least about 95 volume percent of the eutectic reaction phases and the microstructure is free of primary carbide phases.

2. The nickel-based alloy according to claim 1, comprising: carbon from about 1 to about 1.9%; manganese up to about 0.6%; silicon up to about 0.7%; chromium from about 26 to about 33%; molybdenum from at least 6.5 to about 10%; tungsten from about 14.5 to about 16.5%; cobalt up to about 0.6%; iron from about 5 to about 8.5%; nickel from about 29 to about 44%; and incidental impurities.

3. The nickel-based alloy according to claim 1, comprising:
carbon from about 1.1 to about 1.8%;
manganese from about 0.1 to about 0.6%;
silicon from about 0.1 to about 0.7%;
chromium from about 28.5 to about 33%;
molybdenum from about 7 to about 9%;
tungsten from about 14.5 to about 16.5%;
cobalt up to about 0.6%;
iron from about 5 to about 8.5%;
nickel from about 29 to about 44%; and
incidental impurities.

4. The nickel-based alloy according to claim 1, wherein the eutectic reaction phases are uniformly distributed in the microstructure.

5. The nickel-based alloy according to claim 1, wherein the nickel-based alloy has a compressive yield strength of at least about 100 ksi at a temperature of from about 75° F. to about 1000° F.

6. The nickel-based alloy according to claim 1, wherein the nickel-based alloy has an ultimate tensile rupture strength of from about 40 to about 70 ksi at a temperature from about 77° F. to about 600° F., wherein the ultimate tensile rupture strength is greater than about 60 ksi at a temperature of about 77° F.

7. The nickel-based alloy according to claim 1, wherein the nickel-based alloy has an as-cast bulk hardness of greater than 54 HRc.

8. A nickel-based alloy consisting essentially of, in weight percent, carbon from about 0.7 to about 2%; manganese up to about 1.5%; silicon up to about 1.5%; chromium from about 25 to about 36%; molybdenum from at least 5 to about 12%; tungsten from about 12 to about 20%; cobalt up to about 1.5%; iron from about 3.5 to about 10%; nickel from about 20 to about 55%; and incidental impurities, the alloying having an as-cast bulk hardness of over 52 HRc and a microstructure comprising eutectic reaction phases having a lamellar morphology and at least about 95 volume percent of the eutectic reaction phases and the microstructure is free of primary carbide phases.

* * * * *